US006250754B1

(12) United States Patent
Bortolotti

(10) Patent No.: US 6,250,754 B1
(45) Date of Patent: Jun. 26, 2001

(54) DUPLEX PRINTER

(75) Inventor: Giuseppe Bortolotti, Yverdon-les-Bains (CH)

(73) Assignee: Olivetti Lexikon S.p.A., Ivrea (IT)

( * ) Notice: Subject to any disclaimer, the term of this patent is extended or adjusted under 35 U.S.C. 154(b) by 0 days.

(21) Appl. No.: 09/295,383

(22) Filed: Apr. 21, 1999

(30) Foreign Application Priority Data

Apr. 23, 1998 (CH) ..... 0928/98

(51) Int. Cl.[7] ..... B41J 2/01
(52) U.S. Cl. ..... 347/104; 400/605
(58) Field of Search ..... 347/104, 105, 347/101; 400/76, 605; 271/3.19

(56) References Cited

U.S. PATENT DOCUMENTS 4,453,841 * 6/1984 Bobick et al. ..... 400/126
4,918,490 4/1990 Stemmle ..... 355/318
5,820,282 * 10/1998 Nakai ..... 400/642
5,991,564 * 11/1999 Ni ..... 118/60

* cited by examiner

*Primary Examiner*—John S. Hilten
*Assistant Examiner*—Darius N. Cone
(74) *Attorney, Agent, or Firm*—Banner & Witcoff, LT

(57) ABSTRACT

The printer comprises a first receptacle (11) for the sheets to be printed, a sheet feeding path (27) with a printing zone (14) and a second receptacle (15) for the printed sheets. The latter is integral with an intermediate storing device having storage trays (42, 43) thus forming a group (44) which can be pivoted about a shaft (45). The sheets printed on a first face are fed by conveying members (57) into the storage trays, retained for drying, fed again into the feeding path (27) where they are reversed for printing on their second face and then arranged in the second receptacle (15).

Accordingly a duplex printer is obtained, which can be used reliably with ink jet printheads, and which works dependably, has low overall dimensions and is simple and inexpensive to build.

6 Claims, 6 Drawing Sheets

DUPLEX PRINTER

FIELD OF THE INVENTION

This invention relates to a printer comprising a frame, at least one first receptacle for the sheets to be printed, a sheet feeding path with a printing zone and at least one second receptacle for receiving the printed sheets.

BACKGROUND OF THE INVENTION

Duplex printing within the framework of printers using an ink that needs a certain length of time to dry, such as ink jet printers, is delicate on account of the fact that the ink of a sheet printed on its front face can easily come into contact with members of the printer, such as the guiding walls, during the reversal of the sheet, giving rise to undesirable ink erasures and blotches.

A large size printer is known from U.S. Pat. No. 4,918,490 in which the sheets slide, between the printing of the first and of the second face, in a long guiding channel the length of which is approximately three sheets. In this channel, the printed face touches the walls of the channel. For this reason, the arrangement described in this American patent cannot be used as part of ink printers having a more or less lengthy drying time, such as ink jet printers. Moreover, the printer described in this American patent is complex to build and has large overall dimensions, making it impossible to use for many applications.

SUMMARY OF THE INVENTION

The object of this invention is to overcome the drawbacks cited above and to create a printer permitting reliable duplex printing, including with inks having a relatively long drying time, such as ink jet printers. This printer shall in addition have to be easy to build and low reduced overall dimensions, while ensuring high quality printing. The cost price of the printer, moreover, shall have to be as low as possible.

The printer according to the invention is accordingly characterized by the fact that it comprises an installation for the duplex printing of sheets with an intermediate storing device having at least one storage tray, this installation being equipped with a control mechanism suitable for displacing the intermediate storing device so that the sheet or sheets printed on a first face can, successive to a printing exit, be fed into the storage tray or trays, in which a sheet is retained with its printed face facing upwards and from which the sheet or sheets may be fed again, for the printing of their second face, through a printing entrance into the feeding path, the latter being arranged in such a way that the sheet or sheets effect a reversal between the printing entrance and exit.

Accordingly, the ink still wet from printing can dry during a predetermined period of time when the sheet is kept in the intermediate storage tray. This storage tray is also used as a conveying means for presenting the sheet at the printing entrance again so that printing can be effected on its second face. This disposition therefore permits, reliably and simply, the effecting of duplex printing within the framework of ink jet printers or other types of printers with drying inks. The invention also permits a reduction of the overall dimensions of duplex printers and it is simple to build, using a small number of parts, at a reasonable cost price. The quality and speed of handling of the sheets are also very high.

To advantage, each storage tray comprises substantially at its entrance a conveying device provided for gripping and feeding a printed sheet into the storage tray, for keeping it during the intermediate storage and for feeding it again through the printing entrance into the said feeding path for the printing of its second face.

These characteristics ensure an optimal intermediate storage and drying, while facilitating the handling of the sheets.

According to a preferred embodiment, the second receptacle and the storage tray or trays together form an integral whole, mounted movably on the frame.

A particularly simple construction and very low overall dimensions are accordingly obtained.

Advantageously, the second receptacle is provided, substantially at its entrance, with a number of superposed conveying members identical in number to that of the superposed storage trays, the conveying members of the storage trays and those of the second receptacle being arranged identically, one on top of the other, so that the corresponding conveying members of one of the storage trays and of the second receptacle are suitable for meshing simultaneously with two driving members superposed on the frame and separated from each other by a predetermined distance.

The driving of the sheet conveying members is accordingly performed in a particularly rational and reliable manner and with very few components.

BRIEF DESCRIPTION OF THE DRAWINGS

Other advantages will become apparent from the characteristics set down in the relevant claims and from the description provided below detailing the invention, with the aid of drawings representing schematically and by way of example one embodiment and variants thereof.

DESCRIPTION OF A PREFERRED EMBODIMENT OF THE INVENTION

Figure 1:
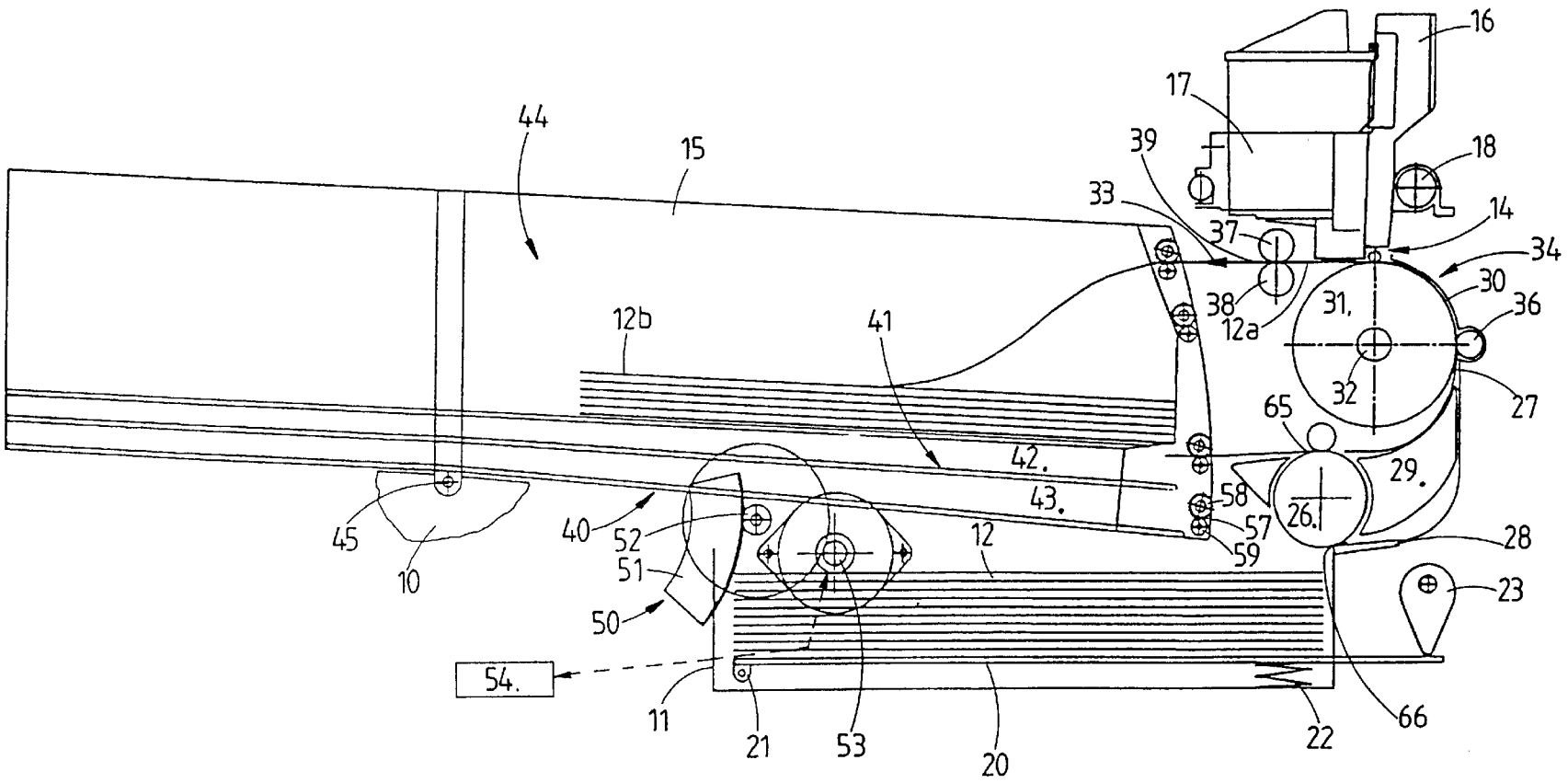
FIG. 1 is a section view of one embodiment of the printer.
Figure 2:
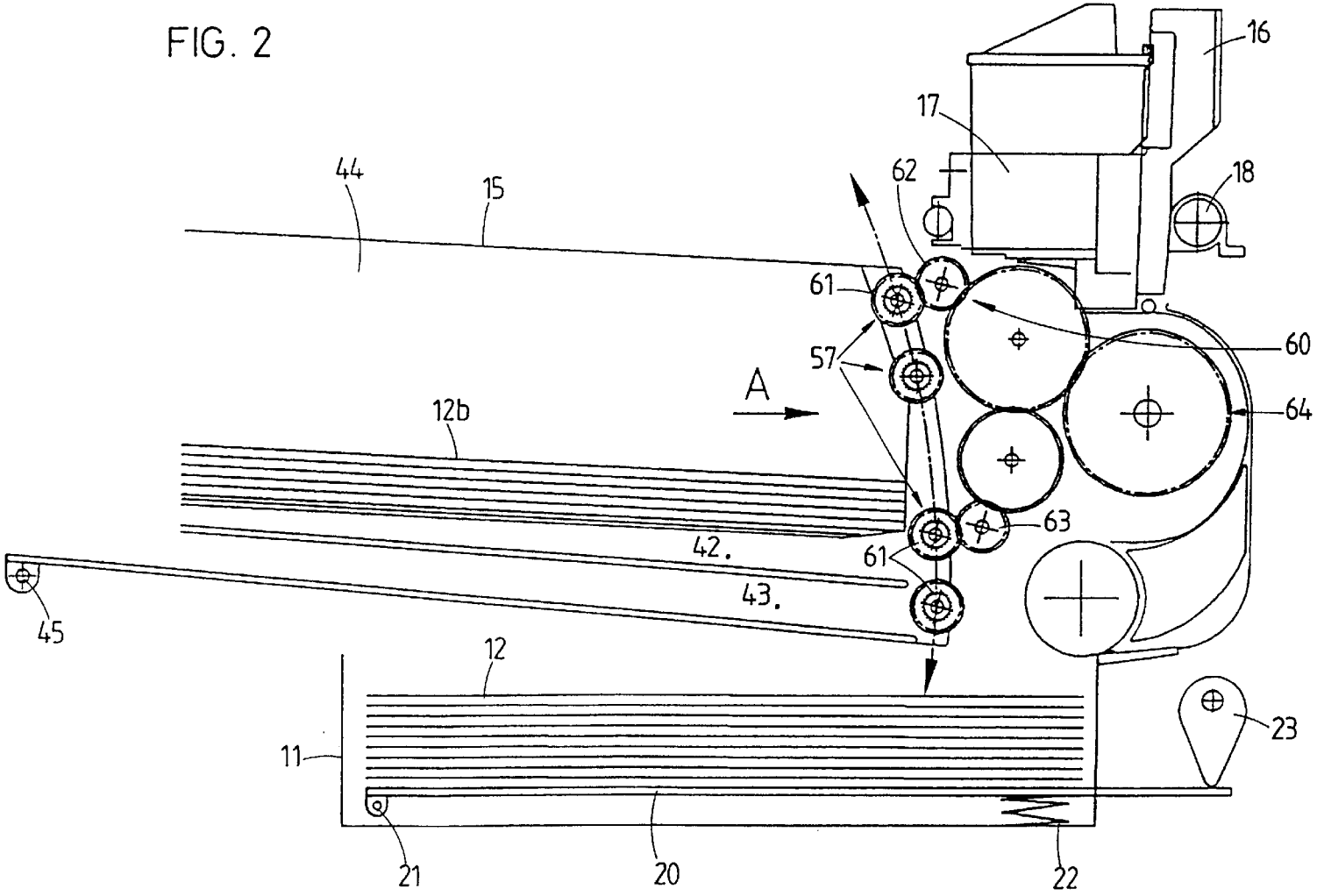
FIG. 2 is a lateral view of this embodiment.

The embodiment of the printer illustrated in figures 1 and 2 comprises a frame 10, a first receptacle 11 for the sheets to be printed 12, a printing zone 14 and a second receptacle 15 provided for receiving the sheets after they have been printed completely.

In the printing zone 14, a printhead 17 is borne by a carriage 16 mounted slidingly on at least one transversal bar 18 and adapted so as to print a sheet 12*a* following a backward and forward movement.

The first receptacle 11 possesses a movable support plate 20 hinge-mounted on the walls of the receptacle according to a pivoting axis 21 and urged by a spring 22 against a command cam 23. When the latter is in the position illustrated, the stack of sheets 12 is in a position withdrawn from the selection rollers 26. Conversely, following rotation of this cam 23 through an angle of 90°, the uppermost sheet of the stack 12 is urged against the selection rollers 26 which, by way of a rotation in the anticlockwise direction, are suitable for feeding the sheet towards the printing zone 14, following a feeding path 27. The latter is bounded by guiding elements 28, 29, 30 and effects a reversal 34 of the sheet about a main roller 31, so that the latter is reversed as it is fed about an axis 32 which is perpendicular to the conveying direction 33 of the sheets. Auxiliary guiding rollers 36, 37, 38 are moreover arranged along this sheet feeding path forming a printing exit 39.

The printer comprises an installation 40 for the duplex printing of the sheets. The latter possesses an intermediate storing device 41 comprising, in this embodiment, two storage trays 42, 43 arranged under the second receptacle 15 and forming with the latter a rigid group 44 mounted pivotingly on the frame 10 according to a pivoting axis 45 which is perpendicular to the conveying direction 33 of the sheets.

A control mechanism 50 permits this group 44 to effect the pivoting movement and comprises a rack 51 forming a partial arc of a circle meshing with a double pinion 52 driven by a step motor 53 controlled by a control unit 54 of the printer.

Each storage tray 42, 43 comprises a conveying member 57 fitted at its entrance. To advantage, this conveying member 57 is comprised by toothed wheels 58 integral with a transversal shaft and co-operating with backing rollers 59.

The second receptacle 15 provided for the printed sheets 12*b* is equipped, substantially at its entrance facing the printhead 17, with a number of superposed conveying members 57 equal in number to that of the superposed storage trays 42, 43, that is to say, in this embodiment, two.

These conveying members of the storage trays, and those of the second receptacle 15, are arranged in identical fashion one on top of the other so that they can be put in meshing engagement simultaneously, two by two, with driving members 60 mounted superposed on the frame 10 at a predetermined distance from each other.

As is shown in FIG. 2, the shafts of the toothed wheels 58 are integral at their extremity, with pinions 61 suitable for meshing with two driving pinions 62, 63 in meshing engagement with a sheet transport gear train 64. Accordingly, the group 44 consisting of the receptacle 15 and the storage trays 42, 43 can be pivoted about the axis 45 in order to activate both the toothed wheels 58 of the lower storage tray 43 and the lower toothed wheels of the second receptacle 15, and also the toothed wheels of the upper storage tray 42 and the upper toothed wheels of the second receptacle 15, in accordance with command signals provided by the control unit 54.

It should be noted that the conveying members 57 of the storage trays are provided for gripping and feeding a printed sheet into the storage tray 42, 43, for retaining it with its printed face facing upwards during the intermediate storage, enabling the ink to dry fully, and for feeding it again through a printing entrance 65 into the feeding path 27 for the printing of its second face.

The storage trays 42, 43 are high enough so that the upper printed surface of the sheets does not touch the walls of the tray, the ink can thus dry without forming blotches. The printing entrance 65 of the sheets coming from the storage trays is different from that 66 for the new sheets selected from the first receptacle 11.

The succession of events of a printing cycle is illustrated in FIGS. 3 to 7. The position illustrated in FIG. 3 corresponds to the stand-by position between two printing cycles. It also corresponds to the position for front face printing, wherein a sheet is selected by the rollers 26 and conveyed to the printing zone 14. The group 44, which together with the control mechanism 50 forms a directing means, is in the lowest position in which the highest conveying member 57*a* is arranged facing the printing zone. The printed sheet 12*a* is gripped by this conveying member 57*a* which places it in the second receptacle 15. The fact that the highest conveying member 57*a* is used means that an optimal thickness of sheets can be placed in the second receptacle 15.

Figure 4:
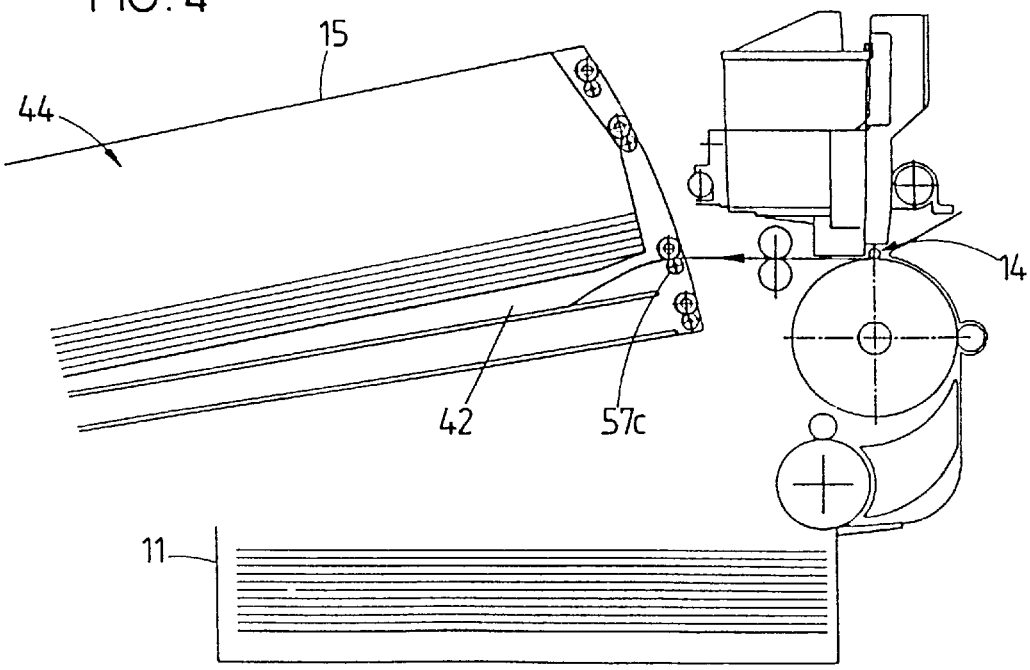

When a duplex printing is commanded, the uppermost sheet of the stack 12 is fed and printed. The group 44 is then turned and raised so that the conveying member 57*c* is facing the printing zone 14 (FIG. 4). The sheet printed on its upper face is fed into the upper storage tray 42. It should be pointed out that the toothed wheels of the conveying member retain this sheet while it is being dried and that this sheet does not touch the walls of the tray.

Figure 5:
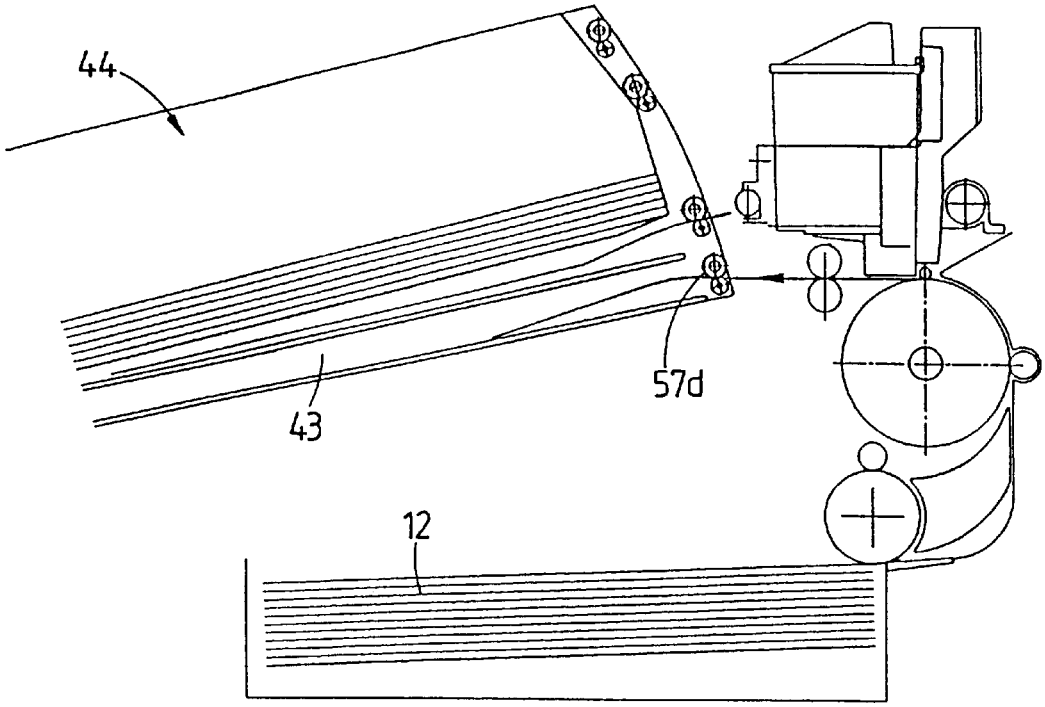

The following sheet is then selected, printed and fed by the conveying member 57*d* into the lower storage tray 43, after the group 44 has been raised by a predetermined angular distance (FIG. 5).

Figure 6:
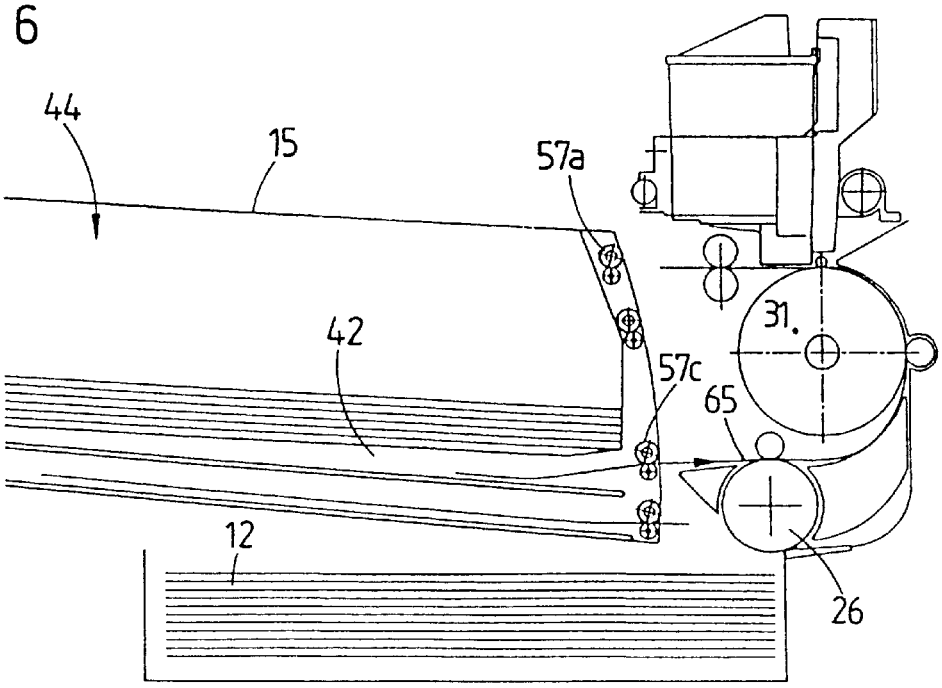

With reference to FIG. 6, this group 44 is then lowered so that the conveying member 57*c* and the upper storage tray 42 are facing the printing entrance 65. The stack of sheets 12 is lowered and removed from the rollers 26.

The first sheet, the ink of which is now dry, is extracted by the conveying member 57*c* from the upper storage tray 42 and fed through the printing entrance 65 towards the printing zone while undergoing a reversal about the main roller 31 so that the already printed face is now facing downwards. The sheet can thus be printed on its back face, gripped by the conveying member 57*a* and placed in the second receptacle 15.

Figure 7:
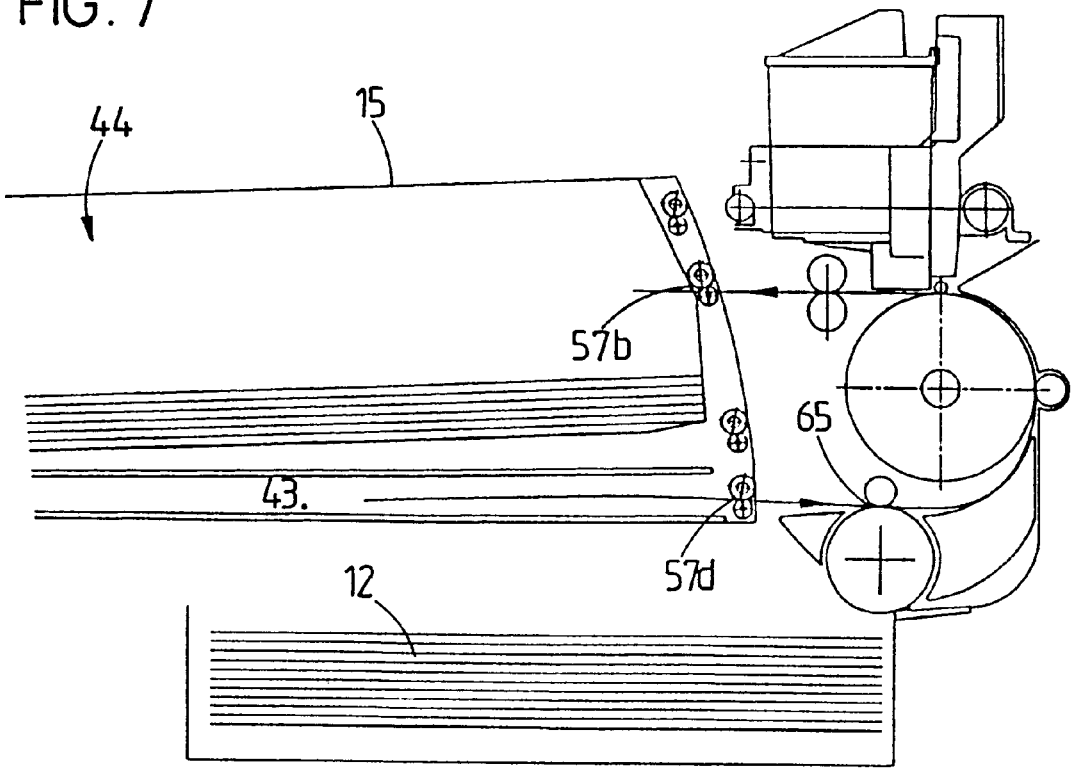

The group 44 is then turned and raised so that the conveying member 57*d* and the lower storage tray 43 are facing the printing entrance 65 (FIG. 7). The sheet stored temporarily in this tray is then fed by the conveying member 57*d*, printed on its back face, gripped by the conveying member 57*b* and placed in the second receptacle 15.

Figure 3:
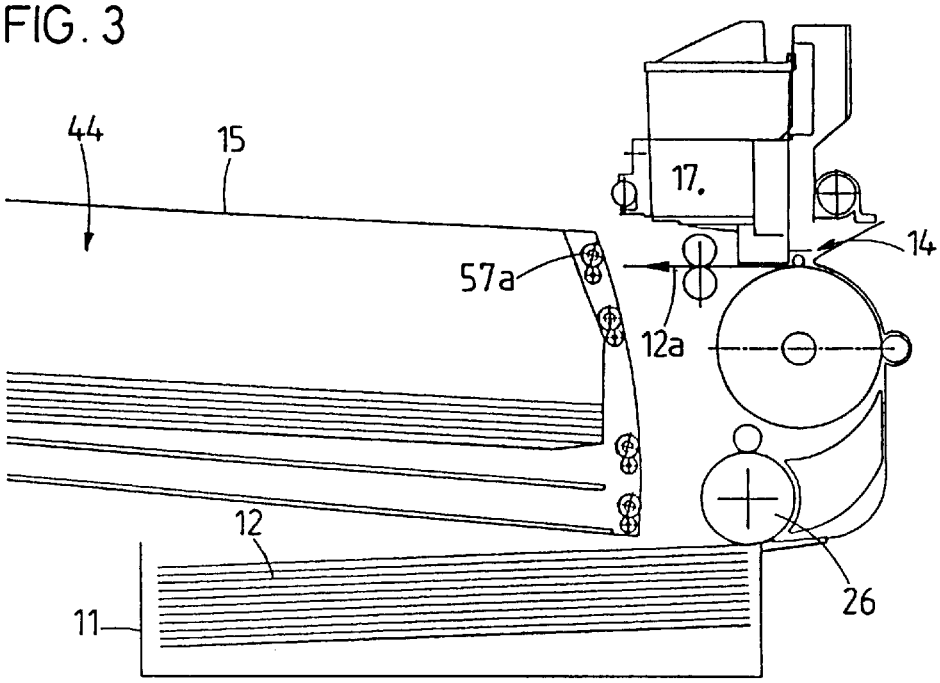
FIGS. 3 to 7 illustrate a sectional view of the printer in different working positions.

A new printing cycle can then commence, or the group can be lowered into the standby position illustrated in FIG. 3.

Accordingly, the intermediate storing device 41 permits a drying of the ink following printing. The printed surface does not rub against the walls of a guiding channel, as is the case in the known printers. The invention is therefore particularly well suited to ink jet printers for which duplex printing installations were not previously suitable. In order to optimise the performance of the printer, some movements may be made simultaneous, provided that the drying time of the ink is respected.

Figure 8:
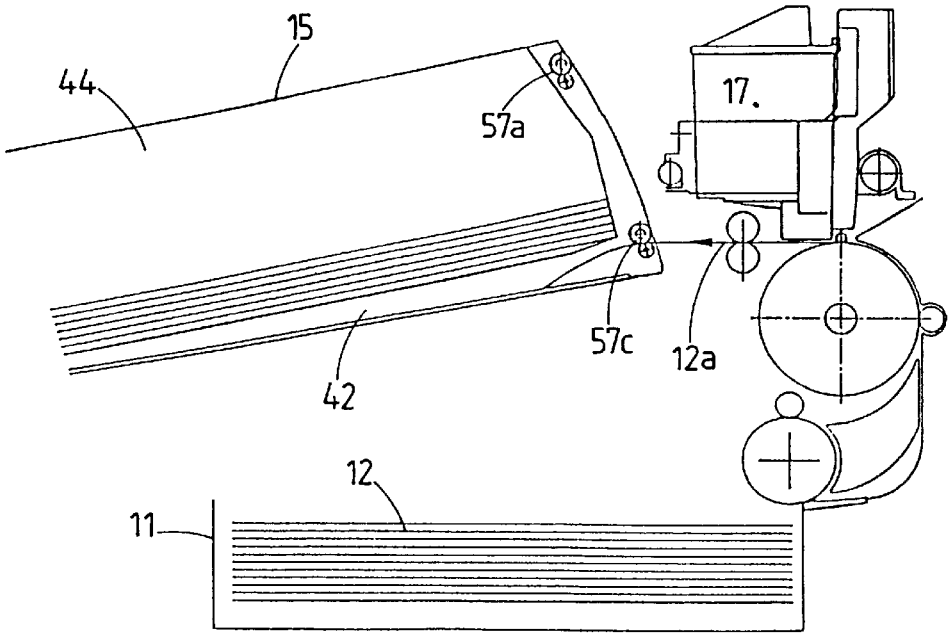
FIGS. 8 and 9 illustrate a sectional view of a variant in two working positions.
Figure 9:
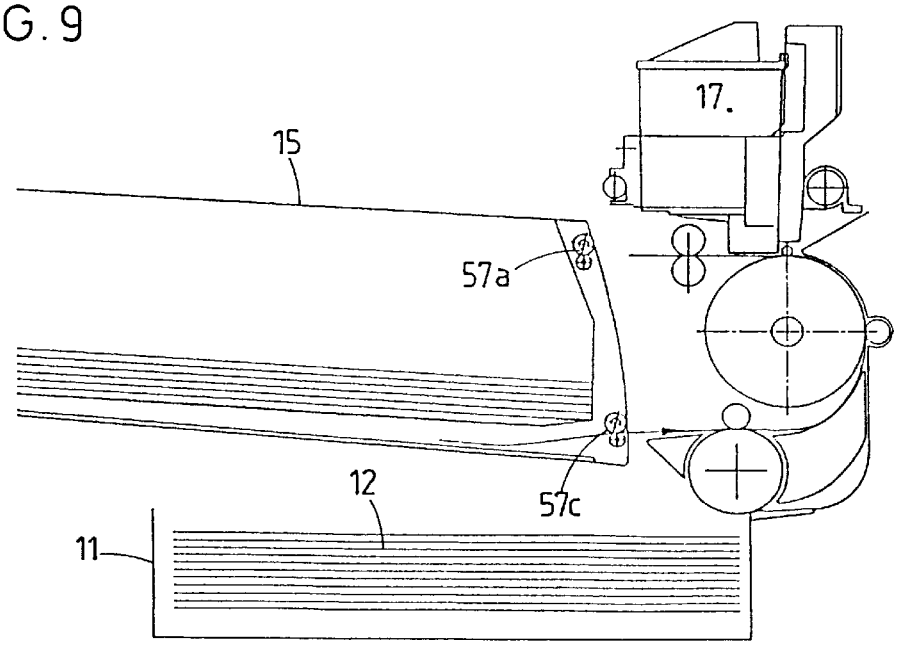

The variant illustrated in FIGS. 8 and 9 differs from the embodiment described above in that it comprises only one intermediate storage tray 42 equipped with one conveying member 57*c*. The second receptacle 15 possesses only one conveying member 57*a*. A sheet 12*a* is selected, printed and fed into the intermediate storage tray 42, when the group 44 is raised (FIG. 8). This group 44 is then lowered and when the ink is dry, the sheet is taken out, printed on the back face, taken again by the conveying member 57*a* and placed in the receptacle 15 (FIG. 9). This simplified variant ensures a reliable duplex printing with uncomplicated equipment and low overall dimensions.

Nevertheless, it implies a sequential treatment of the sheets and of the pages.

Naturally the embodiment and variant thereof described above do not have any restricting characteristics and all the modifications desired may be made thereto within the scope as defined in claim 1. In particular, the first and second receptacles could be arranged differently, for example they could be disposed at either side of the printing zone. The intermediate storage trays could be of a different number, for example 10 in a larger size printer. They could also be separate from the second tray 15 and form a distinct, temporary storage unit. Instead of a pivoting movement, the group 44 could also be displaced by lateral translation. The conveying members 57 could be of a type other than with toothed wheels, for example rollers co-operating with the lateral margins of the sheets.

The feeding path 27 could be disposed differently, but must nonetheless ensure the reversal of the sheet for duplex printing. The invention is particularly well suited to ink jet printers, but may also be advantageously applied on other types of printers.

What I claim is:

1. A printer comprising:

a frame (10);

at least one first receptacle (11) for the sheets to be printed (12);

a sheet feeding path (27) with a printing zone (14);

at least one second receptacle (15) for receiving the printed sheets; and an installation (40) for the duplex printing of the sheets, said installation being equipped with a control mechanism (50) and having an intermediate storing device (41) possessing at least one storage tray (42, 43), wherein said second receptacle (15) and said intermediate storing device (41) including its storage tray(s) (42, 43) form an integral group (44) which is pivotingly mounted on the frame (10) according to a pivoting axis (45) perpendicular to the direction of displacement (33) of the sheets, wherein said second receptacle (15) and said storage tray(s) (42, 43) are provided, substantially at their entrances, with respective conveying members (57*a*, 57*b*, 57*c*, 57*d*), in which the number of the conveying members (57*a*, 57*b*) of said second receptacle (15) is identical to that of said storage tray(s) (42, 43), and said conveying members are arranged in identical fashion one above the other so that the conveying member(s) (57*a*, 57*b*) of said second receptacle and the conveying member(s) (57*c*, 57*d*) of said storage tray(s) (42, 43) are suitable for being in meshing engagement simultaneously with two driving members (61) superposed on the frame (10) and separated from each other by a predetermined distance, wherein said control mechanism (50) is provided for displacing the intermediate storing device (41) together with said second receptacle so that the sheet or sheets printed on a first face are, successively to a printing exit (39), fed into the storage tray(s) (42, 43), in which the sheet or sheets are retained with their printed face facing upwards, and from which the sheet or sheets are fed again, for the printing of their second face, through a printing entrance (65) into the feeding path (27), and wherein said feeding path is arranged in such a way that the sheet or sheets effect a reversal (34) between the printing entrance and exit (65, 39).

2. Printer according to claim 1, wherein said feeding path (27) is arranged in such a way that the sheet effects a reversal (34) about an axis (32) perpendicular to the sheet conveying direction (33).

3. Printer according to claims 1 or 2, wherein each storage tray (42, 43) comprises substantially at its entrance a conveying member (57) provided for gripping and feeding a printed sheet into the storage tray, for keeping it during the intermediate storage, and for feeding it again through the printing entrance (65) into said feeding path (27) for the printing of its second face.

4. Printer according to claim 1, wherein the intermediate storing device (41) with the storage tray(s) (42, 43) is arranged under the second receptacle (15).

5. Printer according to claim 4, wherein the first receptacle (11) is arranged at least partially under the intermediate storing device (41).

6. Printer according to claim 1, wherein the conveying members (57) are comprised by toothed wheels (58) co-operating with backing rollers (59).

* * * * *